US005431450A

United States Patent [19]

Coleman

[11] Patent Number: 5,431,450

[45] Date of Patent: Jul. 11, 1995

[54] MEDICATION BOARD

[76] Inventor: Carol R. D. Coleman, 1613 N. Stone Acre Ave., Compton, Calif. 90221

[21] Appl. No.: 54,866

[22] Filed: Aug. 19, 1993

[51] Int. Cl.[6] ..... B42D 15/00

[52] U.S. Cl. ..... 283/62; 283/115; 283/900; 434/238; 434/416

[58] Field of Search ..... 283/2, 62, 115, 900; 434/238, 408, 416, 417, 418, 415

[56] References Cited

U.S. PATENT DOCUMENTS

| | | | |
|---|---|---|---|
| 3,964,195 | 6/1976 | Jordan | 283/2 X |
| 4,148,273 | 4/1979 | Hollingsworth et al. | 283/900 X |
| 4,614,360 | 9/1986 | Sheehan et al. | 283/900 X |
| 4,815,767 | 3/1989 | Lambert | 283/900 X |
| 5,031,937 | 7/1991 | Nellhaus | 283/900 X |
| 5,102,169 | 4/1992 | Mayfield | 283/115 |
| 5,176,522 | 1/1993 | Robertson, Jr. | 434/408 X |
| 5,207,580 | 5/1993 | Strecher | 434/238 |
| 5,261,702 | 11/1993 | Mayfield | 283/115 |

FOREIGN PATENT DOCUMENTS

| | | | |
|---|---|---|---|
| 3540736 | 5/1987 | Germany | 283/900 |
| 1450281 | 9/1976 | United Kingdom | 434/408 |

OTHER PUBLICATIONS

Miller's Office Products Catalogue, 1989, pp. 284, 301, 302, 304, & 305, 288, 289.

*Primary Examiner*—Frances Han

[57] ABSTRACT

The disclosure is directed to a chart or a board listing medications, dosages and times to be taken, and notes. There is a medication recessed tray that organizes the user's medicines into one central location. The frequency denotes how frequently a medication is to be taken. Medication name column is where the name of the medication is placed, the type of medication, and the dosage and the usage. The calendar section, labeled Sunday–Saturday, that has square boxes that are to have check marks placed in them only after medication is ingested or applied. Refill column, where refill dates and other refill information is placed. The dot on the refill column is to be colored in if a doctor's visit is required before medication can be refilled. The pertinent medical information column is where the patient can place any information that he or she finds useful. The surface of the board is dry continuous basis. The board is to be marked by a marker.

1 Claim, 2 Drawing Sheets

MEDICATION BOARD

BACKGROUND OF INVENTION

This invention relates to a system for aiding people, particularly the elderly, home bound, drug babies, psych patients and any other persons in the administration of multiple medications. Because of advances in medicine, and today's powerful new drugs, people are living longer, a major problem confronted daily by people, particularly elderly and chronically ill patients, is home implementation of the necessary drug regimen in a safe, accurate and a timely manner. During pharmacological training of nurses and doctors, great emphasis is placed on the absolute necessity for maintaining perfect accuracy in the administration of medications. Errors and misuse can undermine the effectiveness of these drugs and can indeed be dangerous to the patient, causing fatal results and cost billions of dollars annually to out national health care system. In many instances the patients drug regimen includes up to six or more medications to be taken daily. Each medication having its own time table and dosage, and each with accompanying instructions and warnings. Particularly, among elderly patients, the timing and dosage of medicine is subject to frequent change and may vary from day to day. The effort to keep track of such a complexity of information can be confusing and threatening to the patient, causing distress and often prolonging recovery.

Charts currently in use by medical professionals are often difficult for anyone outside the profession to read and understand. Many patients are already disquieted simply by being ill and can become additionally concerned and/or confused with the added burden of having to follow the doctor's orders. Apprehension over possible misuse of the prescribed drugs and other medications only serves to cause further distress. As a Registered Nurse, I have witnessed the misuse of medications and have seen them have fatal results.

Homemade systems are often unworkable for multiple medications, as they can become very complicated and confusing to the patient. Moreover, when the doctor make changes to the regimen, the system may have to be completely revamped.

Plastic box containers work only for those using relatively few medications; they will not accommodate a large multiplicity of medications, for example, 6 to 12 to be taken several times daily, 7 days a week, and of course the medications must be in pill form to be placed in the slots of the plastic containers. Systems such as these are not useful for medications that are sensitive to light or air, neither are they practical for the use of patches, salves, liquid medications or medications that need to be refrigerated. The plastic box containers do not reinforce the name of the medication, the dosage, the usage or what it is for.

The Coleman Medication Board, as designed and invented, can assist with the administration of medication in any form, and also constantly reinforces the name of the medicine, the usage, the dosage, what it is for, and any pertinent information about the medication.

SUMMARY OF THE INVENTION

The present invention relates to a medication management system. The medication management system is geared toward flexible daily use, the system serves to allow the user to schedule the ingestion or application of an assortment of medications during the course of a single day, in which the schedule can be readily modified to accommodate in regimen for a subsequent day. This systems includes a board of white melanin resin with a dry wipeable surface.

The board itself have several components. The surface of the board is divided into multiple sections and columns, and each column is distinguishable with a specific purpose.

After reviewing current products and seeing what the patients come into the emergency room with, the Coleman Medication Board is a simple solution a long felt need with patients administration of complicated medication regimen.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF THE PREFERRED INVENTION

Figure 1:
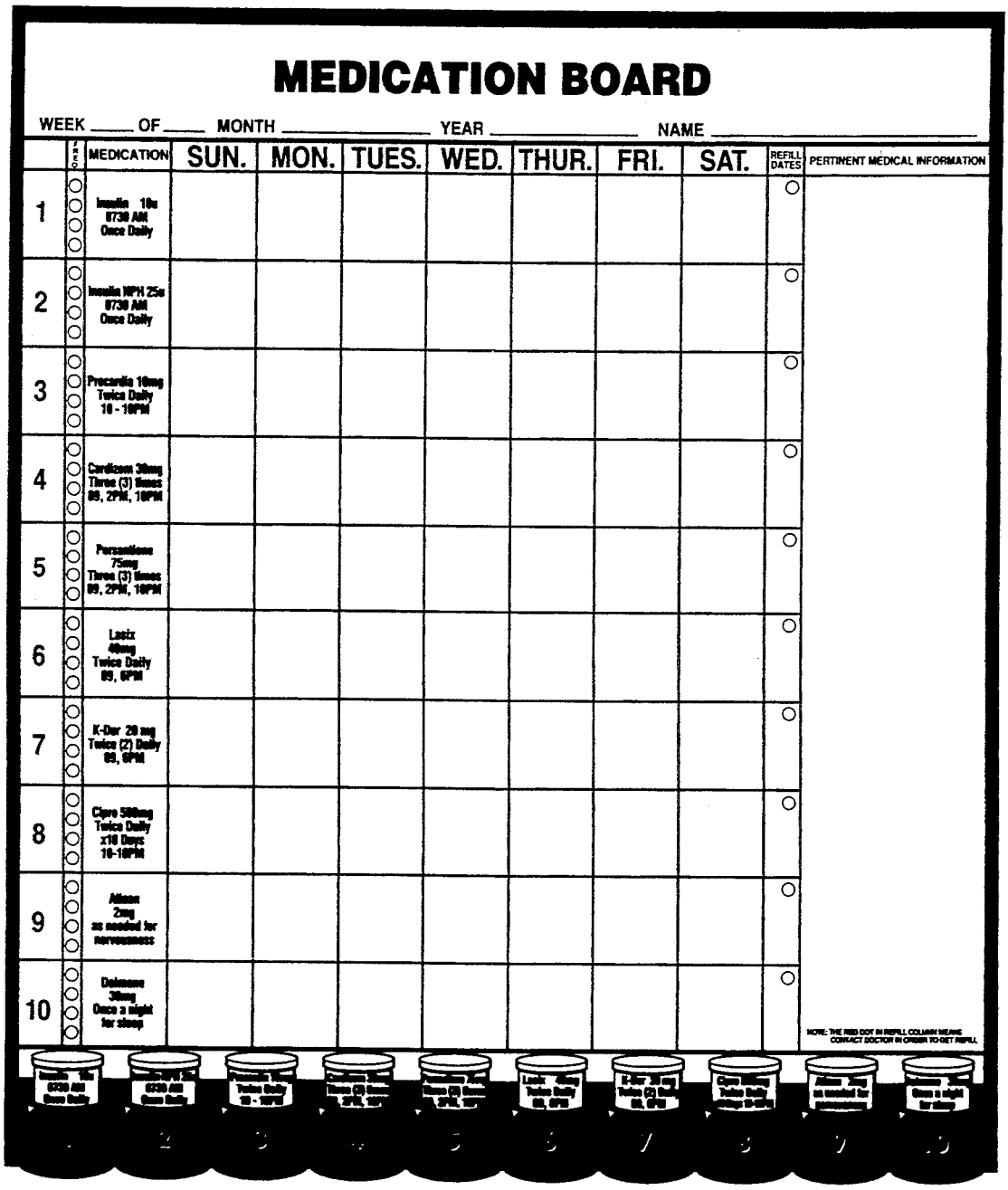
FIG. 1 illustrates a chart in accordance with preferred embodiment of the invention.
Figure 1:
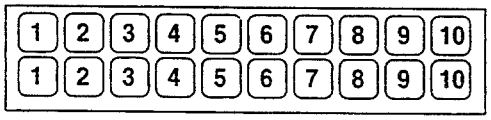
Figure 2:
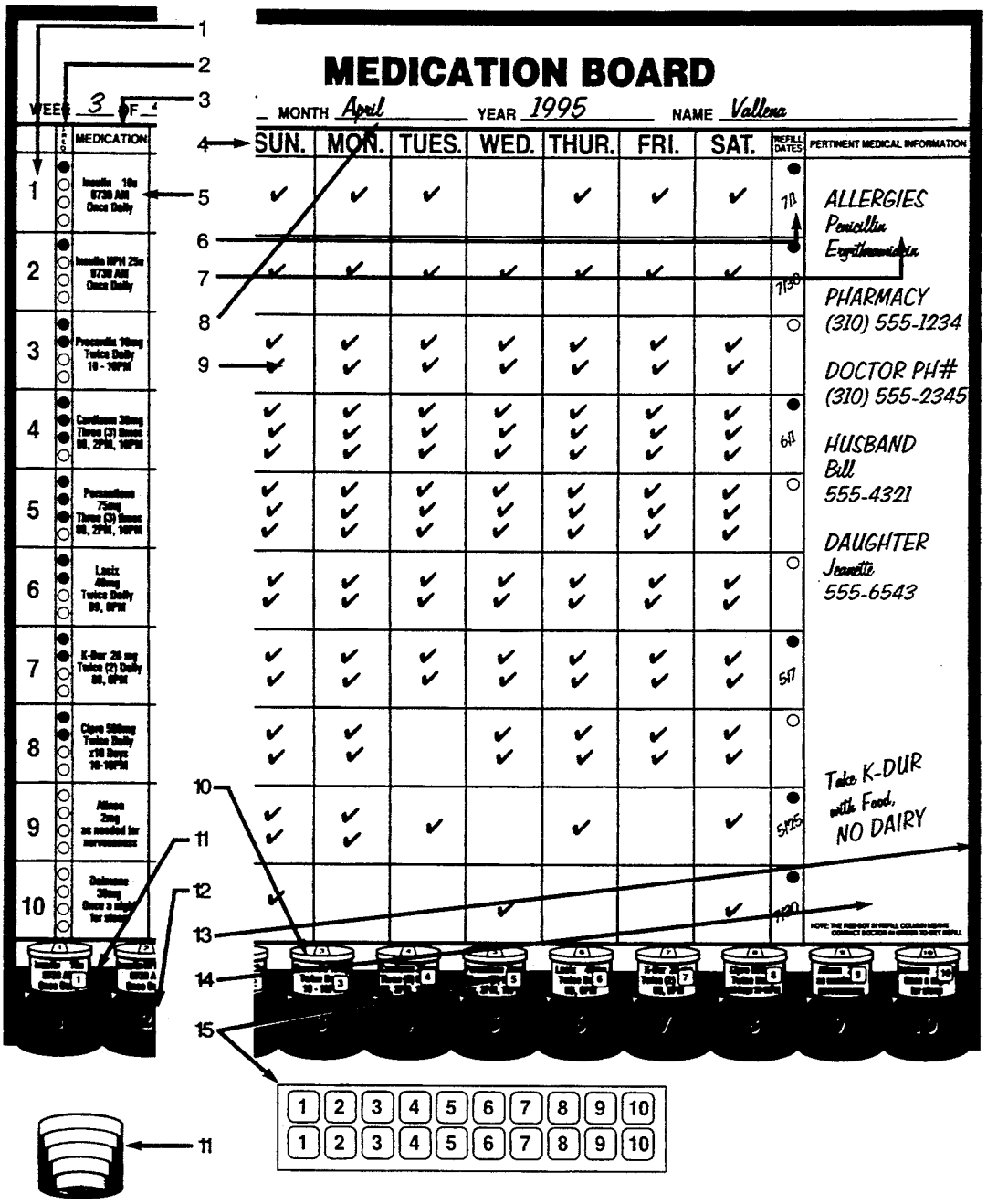
FIG. 2 illustrates the board with medication marker, times and notes thereon.

The present invention comprises an organized system to aid the elderly and infirm, as well as caregivers and nursing professionals, in the proper use and management of multiple medications. The present invention helps establish and maintain individual daily dosages with a simple, changeable system suited to each patient's particular needs. The term "patient," as used throughout the specification and claims, means any persons or even animals requiring a medical management system. The terms "medicine" and "medication" as used throughout the specification and claim means prescription and nonprescription drugs, vitamins, supplements, herbs, foods, bandages or other wraps, first aid devices, cleaning solutions, and the like.

HORIZONTAL (approx. 24")

1. Numerical column with numbers 1–10: These particular numbers correlate with the recess tray at the bottom of the Board. These two work together and complement each other.

2. Frequency (4 dots in each medication space): These dots correlates with the user's dosage of medication. (e.g., if a medication or health product is to be used 2 times a day, 2 dots would be colored in for 2 times a day, 3 dot for 3 times a day, 4 dots for 4 times a day, etc.) if the user takes more than four medications daily, the user may simply add additional dots in the Frequency column.

3. Medication column: The medication column is where the name of the medication goes, the dosage, the time and what the medication is for. This assist the patient with the "five rights" of medication, the right dose, the right time and the right route. This column also tells the patient what the medication is for (i.e., heart pills, blood pressure bills, etc.).

4. Medication days (Sun–Sat): The calendar section of the Board, labeled Sunday through Saturday. This is where the patient places its check mark, only after the medication has been taken. At the end of the day, the checks in the medication calendar section should correlate with the colored-in dots in the Frequency section of the Board. This is a way for the patient to double check his compliance for success.

5. Medication by name: The name of the medication in the medication column.

6. Refill column: This is the column where the patient is to place his refill dates approximately 7 to 10 days before his medication runs, out, and 14 days if the medication requires a doctor's visit for refill.

7. Pertinent Medical Information column: This is where the user would list allergies and any useful information about his/her medication (e.g., iron should be taken with food and preferably with vitamin C). This column can also be used to write down the phone numbers of doctors, clinics, pharmacists, family members, and who to contact in case of emergency (e.g., a young mother with a history of seizures who has a seizure, she can place on the Board the number of the person who is to watch her children if she's transported to the hospital.

VERTICAL (approximately 26")

8. From the frame there is a 3.5"space that allows for the lettering of the board, and the space that indicates month and year. The month and year are erasable so that the patient can use this calendar month-to-month and year-to-year.

9. A block totaling 70 spaces (2" deep and $2\frac{1}{4}$" wide), which is the calendar section of the Medication Board. Check marks are to be placed on the Coleman Medication Board only after the medication or health product is actually taken or applied. At the end of the day, the check marks should correlate with the colored-in dots of the Frequency column for patient to note his/her compliance.

10. A 1"attachment space.

11. A 1.15"space that is the actual medication tray with 10 recessed areas to actually hold the medications. These recessed areas are numbered 1–10 to correlate with the medication column 1–10. The recessed tray is the most novel portion of the board. Its uniqueness is the basic substance that organizes the Coleman Medication Board. It is the tray that actually is the central focus of the board that helps correlate the medication to the Medication column, Frequency column, and makes all three units relatively centrally correlated. The medication in space one in the recessed tray correlates to the medication in space one of the Medication column. This system acts as a constant reinforcement of the name of the medication, the dosage, the time and the rationale, and assist the patient with the "five rights" of the medication laws.

12. The medicine in space #1 on the recessed tray correlates with the information on line #1 of the Medication column (e.g., if antibiotic is listed in space #1 on the Medication Board information system, then that antibiotic would physically be in slot #1 of the recessed tray).

13. The board has a 1"hard plastic black frame around both sides and the top, and the recessed tray acts as the frame for the bottom.

14. Surface: White board that would be made of melamine resin plastic and backed by a thin metallic or fiberboard sheet to provide added strength, commonly called Dry Erase Board.

15. Labels: The labels, numbered 1–10, will be placed on the side or back of the medication bottles, and on the top of the medication bottles. This is to assist the user in case the medication bottles are removed from the tray either accidently or intentionally so that the user may put the recessed tray, so that the medication continues to correlate with the correct number of the Medication column. This is to further assist the user with the correct medication, and the correct dose the correct route, and the correct times so that the patient can continue to be compliant and measure his/her success.

NOTE: ALL SIZES ARE APPROXIMATE

What is claimed is:

1. A daily medication board system comprising:

a dry erase board having a tray with a plurality of recesses attached to the lower end of the board, the dry erase board being divided into sections representing days of the week the pills are due to be taken, said recesses corresponding to the selected type of pills to be taken, a plurality of sets of different colored labels which are fixed to the dry erase board to represent a user's dosage of pills, wherein information about the patient, doctor, hospital, patient's relatives and pharmacy are listed in a column on one section of the board, wherein refill dates corresponding to said selected number of pills are listed in a column on another section of the board.

* * * * *